United States Patent [19]

Pelfrey

[11] Patent Number: 4,796,540

[45] Date of Patent: Jan. 10, 1989

[54] ROLL CRADLE PALLET AND METHOD FOR FABRICATING THE SAME

[75] Inventor: Steven D. Pelfrey, Warren, Mich.

[73] Assignee: Cadillac Products, Inc., Sterling Heights, Mich.

[21] Appl. No.: 142,822

[22] Filed: Jan. 11, 1988

[51] Int. Cl.[4] ..... B65D 19/44

[52] U.S. Cl. ..... 108/55.3; 108/53.1; 108/56.3; 108/901

[58] Field of Search ..... 108/52.1, 901, 902, 108/53.1, 53.3, 55.1, 55.3, 56.1, 56.3, 53.5

[56] References Cited

U.S. PATENT DOCUMENTS

| | | | |
|---|---|---|---|
| 3,472,363 | 10/1969 | Rustin, Jr. et al. | 108/55.3 X |
| 3,590,752 | 7/1971 | DePew | 108/55.3 |
| 3,720,176 | 3/1973 | Munroe | 108/53.1 |
| 3,753,407 | 8/1973 | Tilseth | 108/53.3 |
| 3,880,092 | 4/1975 | Seeber et al. | 108/901 X |
| 4,183,491 | 1/1980 | Sanders et al. | 108/53.3 X |
| 4,597,338 | 7/1986 | Kreeger | 108/56.1 X |

FOREIGN PATENT DOCUMENTS

| | | | |
|---|---|---|---|
| 2337720 | 2/1975 | Fed. Rep. of Germany | 108/55.3 |

*Primary Examiner*—Peter A. Aschenbrenner
*Assistant Examiner*—Thomas A. Rendos
*Attorney, Agent, or Firm*—Harness, Dickey & Pierce

[57] ABSTRACT

Disclosed is a roll cradle pallet having an arcuate support portion to support an object. Also disclosed is a method for fabricating a roll cradle pallet.

23 Claims, 3 Drawing Sheets

ROLL CRADLE PALLET AND METHOD FOR FABRICATING THE SAME

BACKGROUND AND SUMMARY OF THE INVENTION

The subject invention relates to a pallet having a two-piece construction for supporting cylindrical objects.

Wooden flat pallets, comprising a flat upper support surface formed by individually spaced wooden strips and legs extending transversely and downwardly from the strips, are probably the most commonly used type of pallet at the present time. One problem with such wooden pallets, however, is that cylindrical objects tend to roll off the flat upper support surface. Wooden blocks may be used as a wedge to keep the cylinderical object from rolling, however, the edges of the wooden block may cut into into the cylinderical object if it is a delicate material such as cloth or paper. Also, nails and wood slivers can cause problems. Wooden pallets can break under heavy work or abuse, thus presenting a potential safety hazard.

A primary object of the present invention, therefore, is the provision of an improved pallet which overcomes the aforementioned problems associated with wooden pallets. A related object resides in the provision of an improved method of manufacturing such a pallet.

FIGURES IN THE DRAWINGS

Other advantages of the present invention will be readily appreciated as the same becomes better understood by reference to the following detailed description when considered in connection with the accompanying drawings.

DETAILED DESCRIPTION OF THE DRAWINGS

Figure 3:
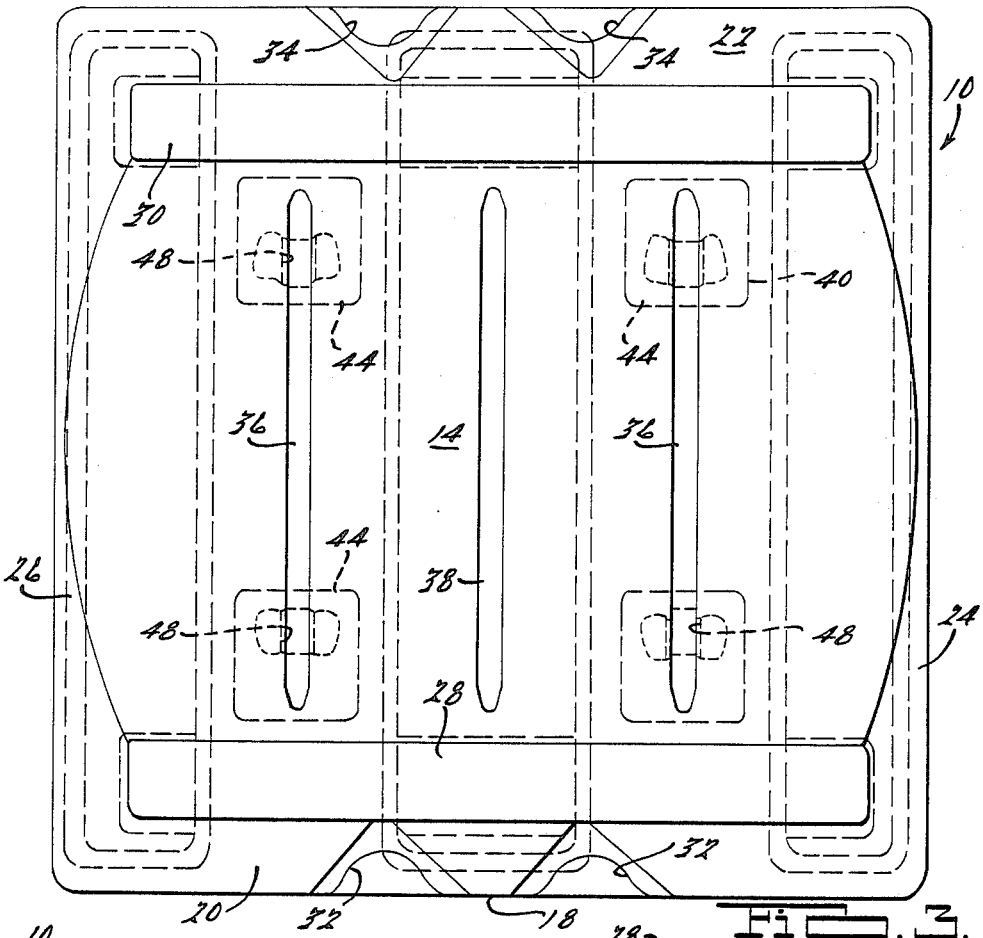
FIG. 3 is a plan view of the pallet of FIG. 1.
Figure 2:
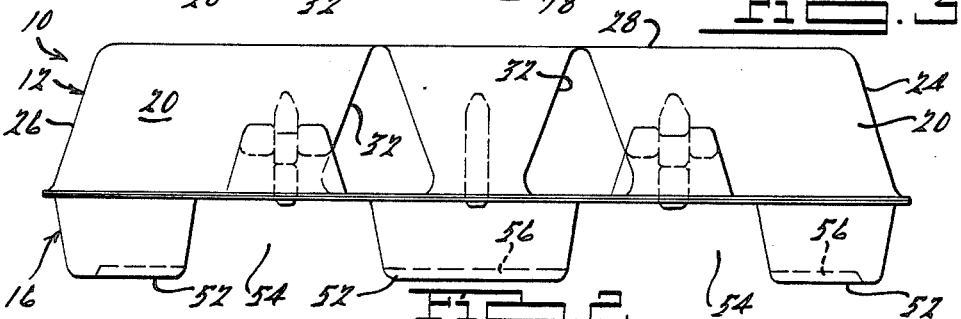
FIG. 2 is a front elevational view of the pallet of FIG. 1.
Figure 1:
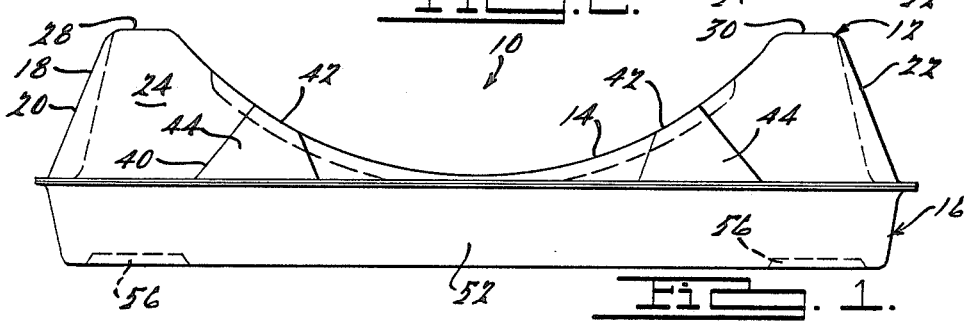
FIG. 1 is a side elevational view of a pallet embodying the principles of the subject invention.

A roll cradle pallet for supporting objects thereupon is generally shown at 10 in FIGS. 1 through 3. The pallet 10 is typically used for supporting an object having at least one curved or arcuate surface, but may be used to support any object configuration. The pallet 10 comprises a first member, generally indicated at 12, having a curved or arcuate support portion 14 to support an object or the curved surface of an object, such as a cylinder or the like. The pallet 10 further comprises a second member, generally indicated at 16, for engaging a support surface to support the first member 12 from the support surface. The first member 12 is supported upon the second member 16 and sealed around the flanges or border between the two by welding or the like to form an integrated or one-piece pallet 10.

Figure 6:
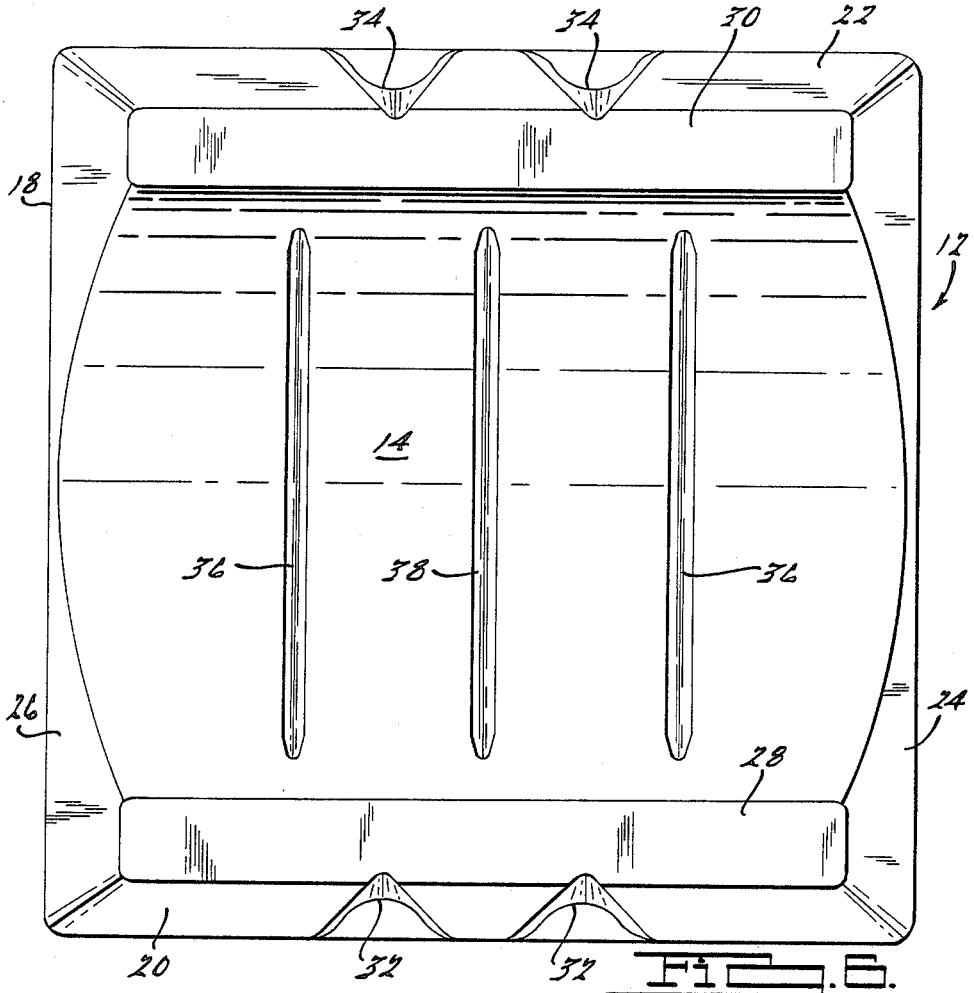
FIG. 6 is a top plan view of the first member of the subject invention.
Figure 5:
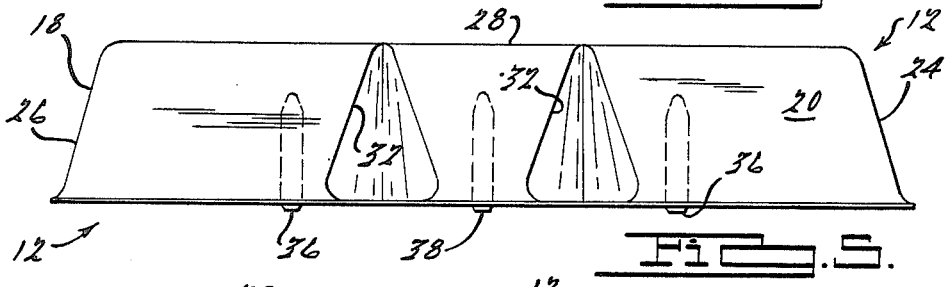
FIG. 5 is a front elevational view of the first member of the subject invention.
Figure 4:
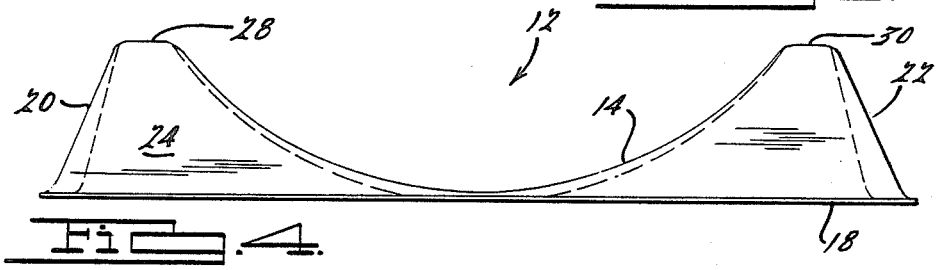
FIG. 4 is a side elevational view of the first member of the subject invention.
Figure 9:
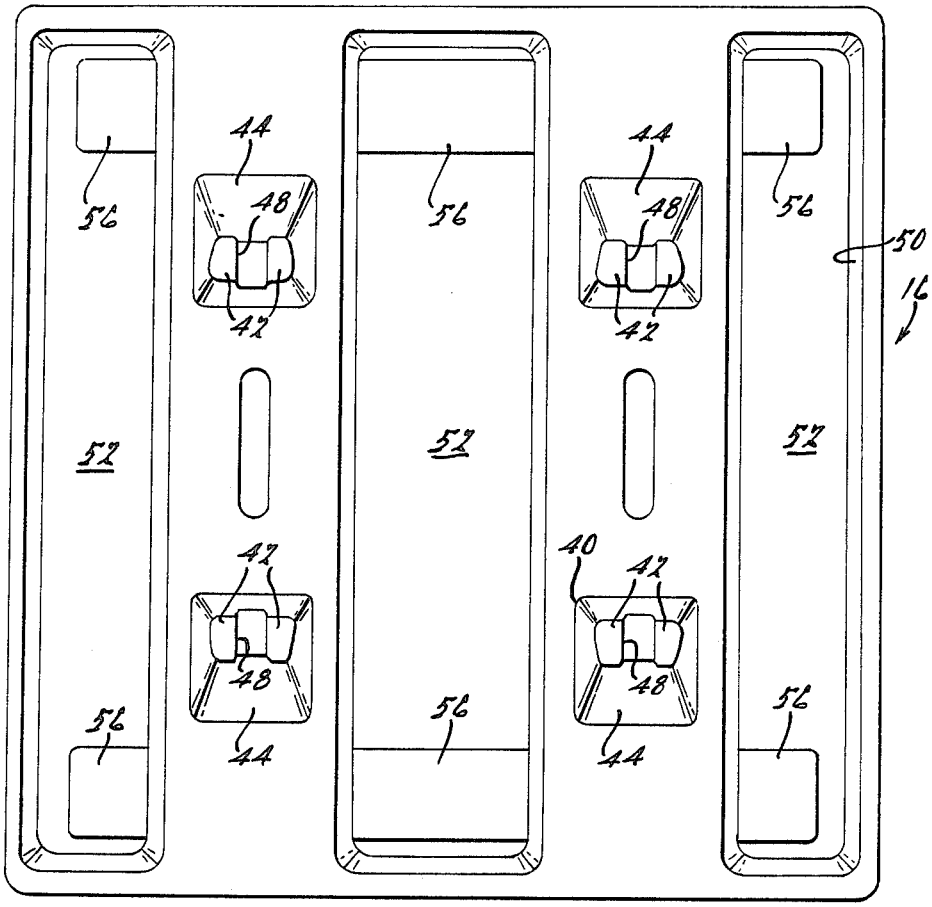
FIG. 9 is a top plan view of the second member of the subject invention.
Figure 8:
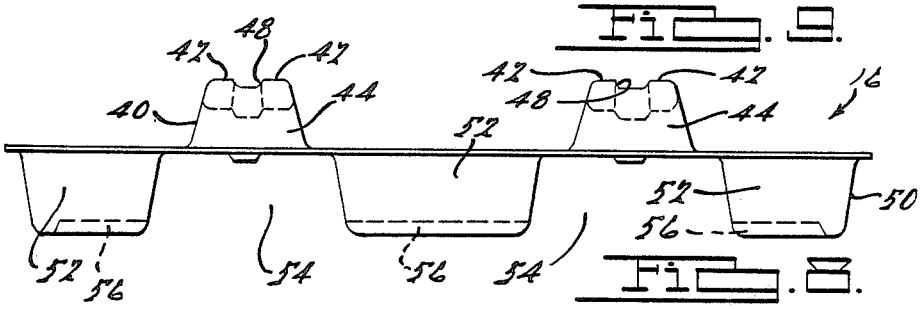
FIG. 8 is a front elevational view of the second member of the subject invention.
Figure 7:
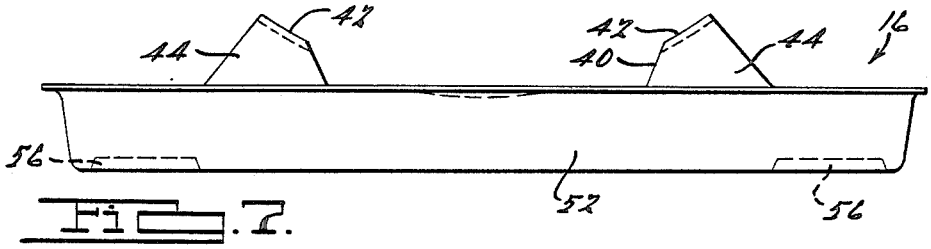
FIG. 7 is a side elevational view of the second member of the subject invention.

As illustrated in FIGS. 4 through 6, the first member 12 includes side wall means 18 for supporting the arcuate support portion 14 at the axial and circumferential ends thereof upon the second member 16. The side wall means 18 comprises side walls 20 and 22 spaced and substantially parallel one from the other at the circumferential ends of the arcuate support portion 14. The side wall means 18 further comprises end walls 24 and 26 axially spaced and substantially parallel one from the other at the axial ends of the arcuate support portion 14. One end of the side walls 20 and 22 are connected to an adjacent end of the end walls 24, 26 to form an integrated rectangular support frame for the axial and circumferential ends of the arcuate support portion 14. The side walls 20 and 22 also include a male portion 28 and 30, respectively, extending outwardly from one end of the side walls 20, 22 along the length thereof. The male portions 28, 30 are rectangularly configured and lie in the same plane above the circumferential ends of the arcuate support portion 14. The side walls 20 and 22 include at least one, and preferably a plurality of, recessed portions 32 and 34, respectively, extending inwardly therefrom to strengthen the side walls 20 and 22. The recessed portions 32, 34 are similar to ribs having a triangular configuration for strengthening the side walls 20, 22.

The arcuate support portion 14 of the first member 12 further includes at least one, and preferably a plurality of, first ribs 36 as depressions extending radially outward and circumferentially along the arcuate support portion 14 to be received or engaged by the second member 16. The arcuate support portion 14 also includes one second rib 38 disposed between a pair of first ribs 36 and extending radially outward and circumferentially along the arcuate support portion 14 to strengthen the arcuate support portion 14. The ribs 36 and 38 are semi-cylindrical or partially arcuate in cross-section and are similar to raised ribs extending radially outward from the arcuate support portion 14 toward the second member 16.

The second member 16 includes protrusion means 40 extending outwardly therefrom for engaging and supporting the arcuate support portion 14 of the first member 12. The protrusion means 40 includes a curved or arcuate surface 42 at the free end thereof configured complementary to the arcuate support portion 14 to nest and support the arcuate support portion 14 of the first member 12 upon the protrusion means 40 to form an integrated pallet 10. The protrusion means 40 comprises at least one, and preferably a plurality of, protrusion members 44 extending outwardly from the second member 16 similar to a post and spaced laterally and longitudinally from each other to engage the arcuate support portion 14 at various locations along the surface thereof. The curved surface 42 is located at the free end of the protrusion member 44. The curved surface 42 of the protrusion member 44 also includes at least one slot 48 formed or recessed in the curved surface 42 of the protrusion member 44. The slot 48 has a configuration complementary to the first rib 36 for receiving the first rib 36 and to operate as a locating means for locating the first member 12 upon the second member 16.

The second member 16 also includes leg means 50 extending outwardly in a direction opposite to the protrusion members 44 for engaging a support surface to support the pallet 10 upon the support surface. The leg means 50 includes at least one, and preferably a plurality of laterally or axially spaced leg members 52 extending outwardly from the second member 16 in a direction opposite to the protrusion members 44. The leg members 52 are laterally spaced one from the other to define at least one, preferably a plurality of, channels 54 between a pair of leg members 52 to permit the entry of a lifting device such as a fork of a fork lift to raise and lower the second member 16 from the support surface. The leg members 52 include a female portion 56 recessed in the leg members 52 across the lateral width thereof and complementary to the male portion 28, 30 for receiving the male portion 28, 30 of the side walls 20, 22, respectively. The female portion 56 of the leg members 52 and the male portion 28, 30 of the side walls 20, 22 operate as a stacking means for stacking the second member 16 of a first pallet upon the first member 12 of a second pallet. Hence, the stacking means 28, 30, 56 allows the second member 16 to be stacked upon the first member 12.

Reinforcement of the leg members 52 relative to first member 12 would allow the pallet to be used in applications requiring the support of objects having a weight which could tend to crush the pallet. Such reinforcement could be provided by stiffening ribs being integrally formed in the vertical side walls defining the leg members 52. Further, separate reinforcing members could be disposed in the interior cavity formed by the leg member. In accord with this invention support beams (e.g., wooden 2"×4"'s) substantially coextensive with the leg member could be placed interiorly of the cavity formed by the leg member.

Recessed portions 32 and 34 could be trapezoidal in shape whereby the inward ribs so formed by the portions provide a handle for the user to grip the pallet for lifting.

Both the first member 12 and second member 16 are made of a polymer material such as high density polyethylene (HDPE) or the like and are fabricated by vacuum forming utilizing conventional techniques.

Accordingly, the roll-cradle pallet 10 is a cost reduction over wooden pallets and the use of a polymer material which may be easily vacuum formed. It also eliminates sharp objects, such as spliners and the like, could damage the cylindrical objects being supported. Further, the cradle eliminates the use of braces, stops or supports as well as strapping merely to secure the cylindrical objects on the pallet. Finally, the roll-cradle pallet is stackable for easy storage.

The subject invention has been described in an illustrative manner. It is to be understood that the terminology which has been used is intended to be in the nature of words of description rather than of limitation.

Obviously, many modifications and variations of the subject invention are possible in light of the above teachings. Therefore, the subject invention may be practiced otherwise than as specifically described.

What is claimed is:

1. A roll cradle pallet for supporting objects comprising; a first member having an arcuate support portion to support an object, and a second member for engaging a support surface and including protrusion means extending outwardly from said second member for engaging and supporting said arcuate support portion of said first member, said protrusion means including a curved surface complementary circumferentially to said arcuate support portion of said first member to nest and support said arcuate support portion of said first member upon said protrusion means of said second member to form an integrated pallet.

2. A pallet as set forth in claim 1 further including locating means for locating said first member upon said second member.

3. A pallet as set forth in claim 2 wherein said locating means includes at least one first rib extending outwardly circumferentially along said arcuate support portion and at least one slot formed in said protrusion means for receiving said first rib.

4. A pallet as set forth in claim 1 wherein said protrusion means comprises at least one protrusion member extending outwardly from said second member, said curved surface being at the free end of said protrusion member to engage and nest said arcuate support portion.

5. A pallet as set forth in claim 4 wherein said first member includes side wall means for supporting said arcuate support portion at the axial and circumferential ends thereof.

6. A pallet as set forth in claim 5 wherein said side wall means comprises side walls spaced and substantially parallel one from another at the circumferential ends of said arcuate support portion and end walls axially spaced and substantially parallel one from another at the axial ends of said arcuate support portion, one end of said side wall being connected to an adjacent end of said end wall.

7. A pallet as set forth in claim 6 including stacking means for stacking said second member of a first pallet upon said first member of a second pallet.

8. A pallet as set forth in claim 7 including leg means extending outwardly from said second member in a direction opposite to said protrusion members for engaging a support surface to support said pallet upon the support surface.

9. A pallet as set forth in claim 8 wherein said leg means includes at least one leg member extending outwardly from said second member in a direction opposite to said protrusion member.

10. A pallet as set forth in claim 8 wherein said leg means includes a plurality of axially spaced leg members extending outwardly from said second member in a direction opposite to said protrusion members.

11. A pallet as set forth in claim 10 including at least one channel defined by said leg members to permit the entry of a lifting device to raise and lower said second member from the support surface.

12. A pallet as set forth in claim 11 wherein said stacking means includes a male portion extending outwardly from one end of said side walls along the length thereof and a female portion recessed in said leg members for receiving said male portion of said side walls.

13. A pallet as set forth in claim 12 wherein said arcuate support portion includes at least one second rib extending outwardly circumferentially along said arcuate support portion.

14. A pallet as set forth in claim 12 including locating means for locating said first member upon said second member.

15. A pallet as set forth in claim 14 wherein said locating means including a plurality of first ribs extending outwardly circumferentially and spaced axially along said arcuate support portion and a slot formed in said curved surface of said protrusion member for receiving said first rib.

16. A pallet as set forth in claim 15 wherein said side walls include at least one recessed portion extending inwardly therefrom to strengthen said side wall.

17. A pallet as set forth in claim 15 wherein said side walls include a plurality of spaced recessed portions extending inwardly along the length thereof to strengthen said side walls.

18. A pallet as set forth in claim 15 wherein said first member and said second member are made of a polymer material.

19. A pallet as set forth in claim 10 including a plurality of channels defined by said leg members to permit the entry of a lifting device to raise and lower said second member from the support surface.

20. A pallet as set forth in claim 10 including stiffening means associated with said leg members for strengthening the leg members.

21. A pallet as set forth in claim 10 wherein said leg members define an interior cavity and said stiffening means comprises a separate reinforcing element being disposed in said cavity.

22. A pallet as set forth in claim 21 wherein the reinforcing element comprises a wooden beam having a length substantially coextensive with that of the cavity.

23. A pallet as set forth in claim 1 wherein said protrusion means comprises a plurality of protrusion members extending outwardly from said second member and spaced laterally and longitudinally from each other, said curved surface being at the free end of said protrusion member to engage and nest said arcuate support portion.

* * * * *